US010067451B1

(12) United States Patent
Iketani

(10) Patent No.: US 10,067,451 B1
(45) Date of Patent: Sep. 4, 2018

(54) IMAGE FORMING APPARATUS

(71) Applicant: KYOCERA Document Solutions Inc., Osaka (JP)

(72) Inventor: Takeshi Iketani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/904,837

(22) Filed: Feb. 26, 2018

(30) Foreign Application Priority Data

Feb. 28, 2017 (JP) ..... 2017-036067

(51) Int. Cl.
*G03G 15/20* (2006.01)
*G03G 15/00* (2006.01)

(52) U.S. Cl.
CPC ..... *G03G 15/2089* (2013.01); *G03G 15/2017* (2013.01); *G03G 15/657* (2013.01)

(58) Field of Classification Search
CPC ..... G03G 15/2089
See application file for complete search history.

(56) References Cited

U.S. PATENT DOCUMENTS

2013/0302054 A1* 11/2013 Uehara ..... G03G 15/2064 399/67

FOREIGN PATENT DOCUMENTS

JP 2012-177789 A 9/2012

* cited by examiner

*Primary Examiner* — Clayton E Laballe
*Assistant Examiner* — Jas Sanghera
(74) *Attorney, Agent, or Firm* — Studebaker & Brackett PC

(57) ABSTRACT

An image forming apparatus includes a main body and a fixing unit. The fixing unit is attachable to and detachable from the main body. The fixing unit includes a heating roller, a pressure roller, and a pressing member. The pressing member presses the pressure roller against the heating roller. The main body includes a cam and a slope member. The cam changes a pressing state of the pressing member. The slope member guides a lower end of the pressing member to a topmost part of the cam in attachment of the fixing unit to the main body.

9 Claims, 9 Drawing Sheets

IMAGE FORMING APPARATUS

INCORPORATION BY REFERENCE

The present application claims priority under 35 U.S.C. § 119 to Japanese Patent Application No. 2017-036067, filed on Feb. 28, 2017. The contents of this application are incorporated herein by reference in their entirety.

BACKGROUND

The present disclosure relates to an image forming apparatus.

A fixing unit includes a heating roller, a pressure roller, a pressure arm, a spring, and a cam. When the cam pushes up the spring, the spring presses the pressure arm. As a result, pressing force acting between the pressure roller and the heating roller increases. By contrast, when the cam does not push up the spring, the pressing force acting between the pressure roller and the heating roller decreases.

SUMMARY

An image forming apparatus according to the present disclosure includes a main body and a fixing unit. The fixing unit is attachable to and detachable from the main body. The fixing unit includes a heating roller, a pressure roller, and a pressing member. The pressing member presses the pressure roller against the heating roller. The main body includes a cam and a slope member. The cam changes a pressing state of the pressing member. The slope member guides a lower end of the pressing member to a topmost part of the cam in attachment of the fixing unit to the main body.

BRIEF DESCRIPTION OF THE DRAWINGS

FIG. 5A is a diagram illustrating a state in which the pressing member is pushed up to an upper limit position by the cam. FIG. 5B is a diagram illustrating a state in which the pressing member descends to a lower limit position.

FIG. 7A is a diagram illustrating a state in which the cam is located at an upper limit position. FIG. 7B is a diagram illustrating a state in which the cam is located at a lower limit position.

FIG. 8A is a diagram illustrating a state in which the cam is located at the upper limit position. FIG. 8B is a diagram illustrating a state in which the cam is located between the upper limit position and the lower limit position. FIG. 8C is a diagram illustrating a state in which the cam is located at the lower limit position.

FIG. 9A is a side view illustrating a state in which the fixing unit is in the course of being attached to the main body. FIG. 9B is a side view illustrating a state in which the fixing unit is attached to the main body.

DETAILED DESCRIPTION

Figure 1:
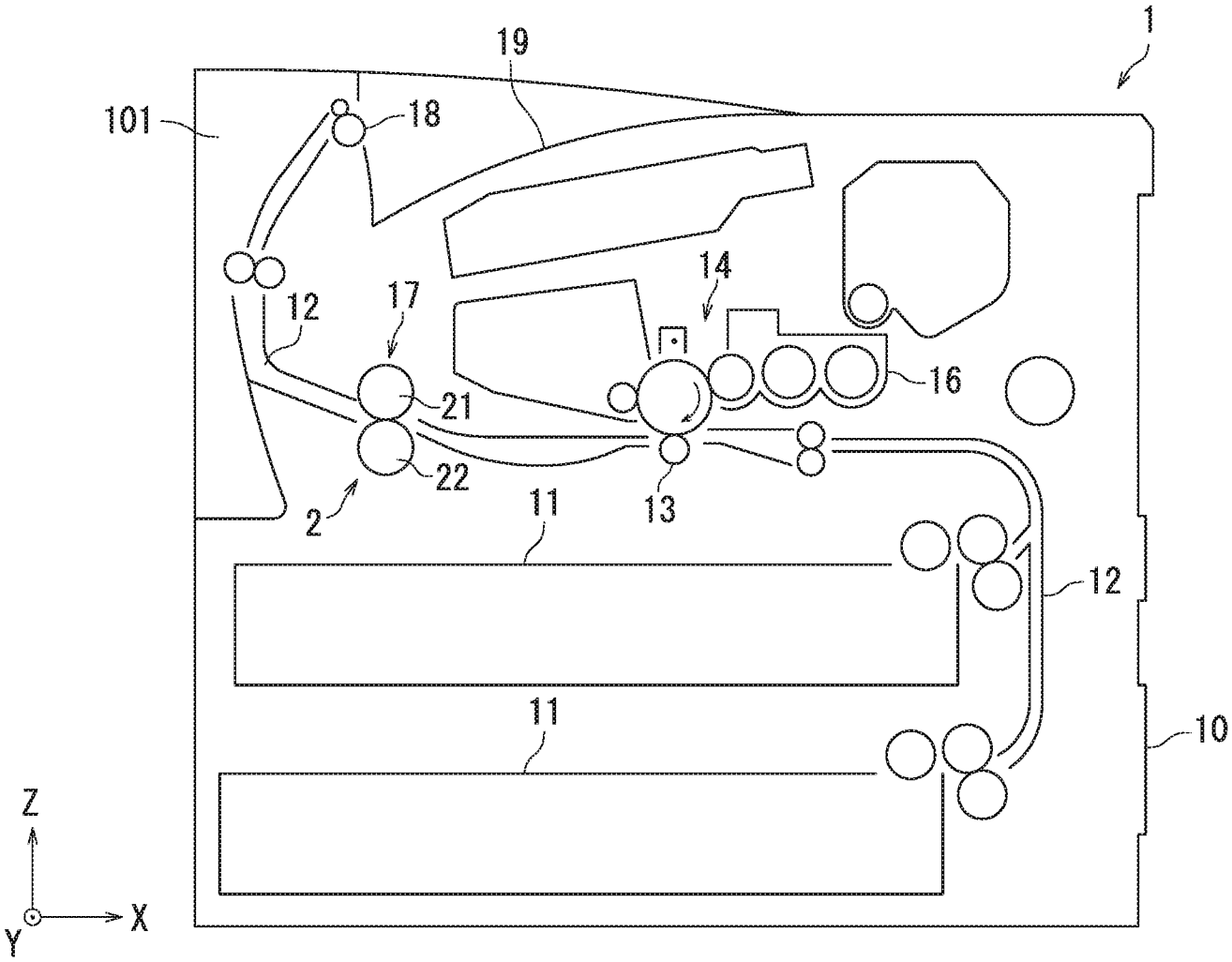
FIG. 1 is a side view illustrating a configuration of an image forming apparatus according to an embodiment of the present disclosure.

The following describes an embodiment of the present disclosure with reference to the drawings (FIGS. 1 to 9B). Note that in the drawings, elements that are the same or substantially equivalent are labelled using the same reference signs and explanation thereof will not be repeated.

First, an image forming apparatus 1 according to the embodiment of the present disclosure will be described with reference to FIG. 1. FIG. 1 is a diagram illustrating a configuration of the image forming apparatus 1. As illustrated in FIG. 1, the image forming apparatus 1 is a printer. The image forming apparatus 1 includes a main body 10 and a fixing unit 2. The main body 10 includes a paper feed cassette 11, a conveyance section 12, an image forming section 14, an ejection section 18, and an exit tray 19. The image forming section 14 includes a transfer section 13 and a development section 16. The fixing unit 2 includes a fixing section 17. The main body 10 further includes a rear cover 101.

FIG. 1 illustrates an X axis, a Y axis, and a Z axis, which are orthogonal to one another. The X axis and the Y axis are parallel to a horizontal plane. The Z axis is parallel to a vertical direction. In the following description, a positive side of the X axis (i.e., a side indicated by an arrow representing the X axis) may be referred to as a front side, and a negative side of the X axis (i.e., a side opposite to the side indicated by the arrow representing the X axis) may be referred to as a rear side.

The paper feed cassette 11 feeds paper to the conveyance section 12. The conveyance section 12 conveys the paper to the ejection section 18 via the transfer section 13 and the fixing section 17.

The image forming section 14 forms an image on the paper. The image forming section 14 includes a photosensitive drum. An electrostatic latent image is formed on the photosensitive drum. The development section 16 forms a toner image by supplying toner to the electrostatic latent image. The transfer section 13 transfers the toner image formed on the photosensitive drum onto the paper. Through the above, an image is formed on the paper.

The fixing section 17 includes a heating roller 21 and a pressure roller 22. The fixing section 17 applies heat and pressure to the paper by interposing the paper between the heating roller 21 and the pressure roller 22. Thus, the fixing section 17 fixes to the paper the image formed on the paper. The ejection section 18 ejects the paper to the exit tray 19. The paper ejected by the ejection section 18 is placed on the exit tray 19.

The rear cover 101 is a part of side surfaces of the main body 10. Specifically, the rear cover 101 is a part of a side surface of the main body 10 located on the negative side of the X axis.

Figure 2:
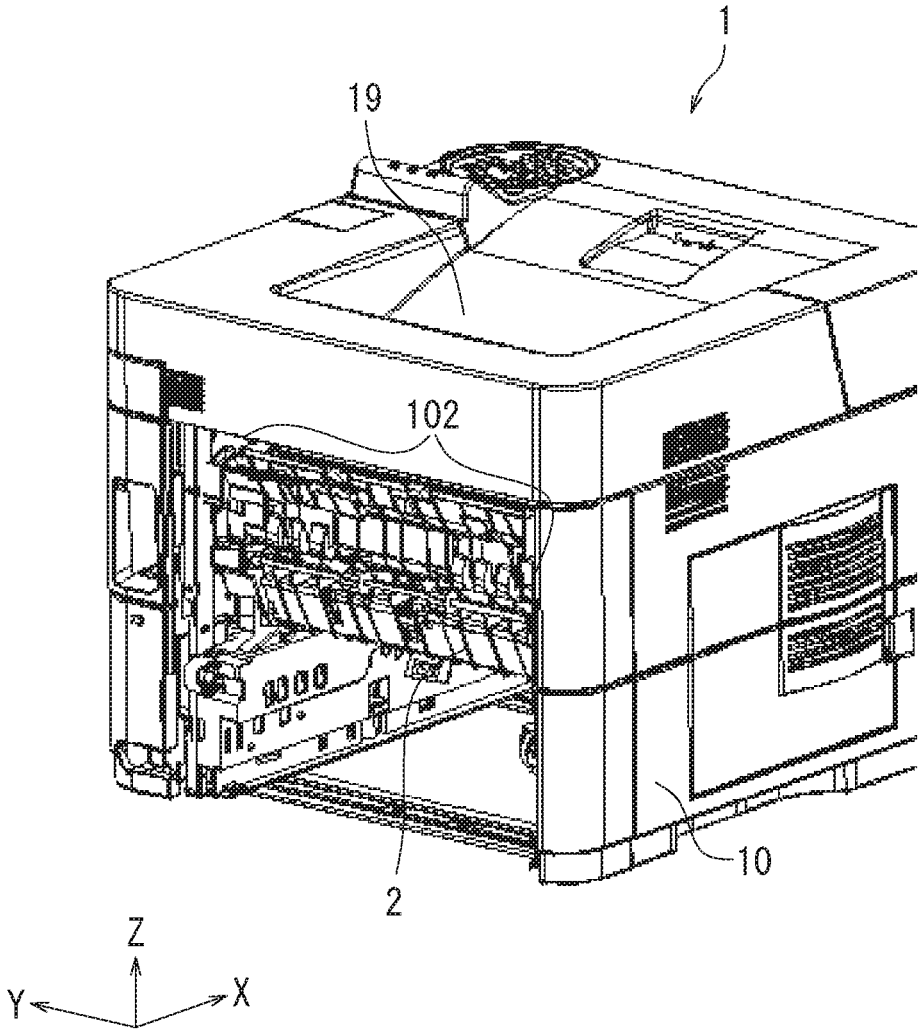
FIG. 2 is a perspective view illustrating a state in which a fixing unit is attached to a main body.

The following further describes the configuration of the image forming apparatus 1 with reference to FIGS. 1 and 2. FIG. 2 is a perspective view illustrating a state in which the fixing unit 2 is attached to the main body 10. Note that the rear cover 101 is removed in FIG. 2.

The main body 10 has a rectangular opening 102 on the rear side (the negative side of the X axis) thereof. The rear cover 101 opens and closes the opening 102.

The fixing unit 2 is attachable to and detachable from the main body 10. The fixing unit 2 is removed toward the negative side of the X axis through the opening 102. Also, the fixing unit 2 is attached to the main body 10 through the opening 102.

The exit tray 19 also serves as an upper cover of the main body 10.

Figure 3:
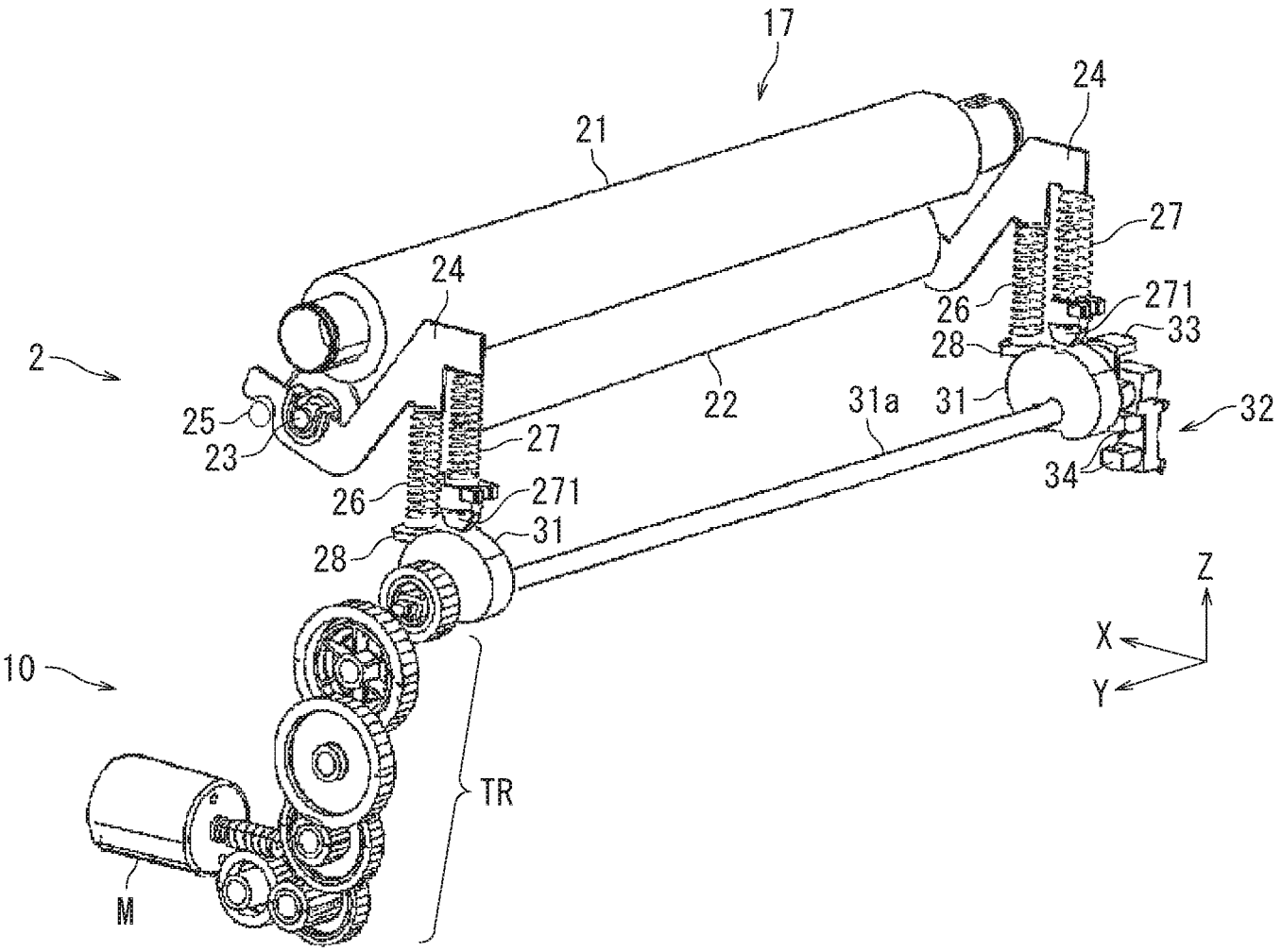
FIG. 3 is a perspective view illustrating a structure for adjusting pressing force acting between a heating roller and a pressure roller.

The following describes a structure for adjusting pressing force acting between the heating roller 21 and the pressure roller 22 with reference to FIGS. 1 to 3. FIG. 3 is a perspective view illustrating the structure for adjusting the pressing force acting between the heating roller 21 and the pressure roller 22.

As illustrated in FIG. 3, the fixing unit 2 further includes pressure arms 24, spindles 25, first springs 26, second springs 27, pressing members 271, and fixing frames 28. The main body 10 further includes a motor M, a deceleration gear train TR, cams 31, a shaft 31*a*, and a detector 32.

The pressure roller 22 includes a rotary shaft 23. The rotary shaft 23 extends through an axial center of the pressure roller 22.

The pressure arms 24 support respective opposite ends of the rotary shaft 23 in a rotatable manner. The spindles 25 support the respective pressure arms 24 in a pivotable manner. One end (an end on the positive side of the X axis) of each of the pressure arms 24 is supported by a corresponding one of the spindles 25. Another end of each of the pressure arms 24 is engaged with a corresponding one of the first springs 26 and a corresponding one of the second springs 27.

The first springs 26 urge the respective pressure arms 24 in a positive direction of the Z axis (i.e., upwards). The first springs 26 are each arranged such that its central axis is parallel to the Z axis. Specifically, one end (a lower end) of each of the first springs 26 located on a negative side of the Z axis (i.e., a side opposite to a side indicated by an arrow representing the Z axis) is fixed to a corresponding one of the fixing frames 28. Another end (an upper end) of each of the first springs 26 located on a positive side of the Z axis (i.e., the side indicated by the arrow representing the Z axis) is engaged with a corresponding one of the pressure arms 24. The first springs 26 are each attached between a corresponding one of the fixing frames 28 and a corresponding one of the pressure arms 24 in a compressed state. As a result, the first springs 26 urge the respective pressure arms 24 in the positive direction of the Z axis (i.e., upwards).

The second springs 27 urge the respective pressure arms 24. The second springs 27 are each arranged such that its central axis is parallel to the Z axis.

The pressing members 271 press the pressure roller 22 against the heating roller 21 via the second springs 27 and the pressure arms 24. An upper end of each of the pressing members 271 is fixed to one end of a corresponding one of the second springs 27 located on the negative side of the Z axis. A lower end of each of the pressing members 271 is in contact with an outer circumferential surface of a corresponding one of the cams 31. That is, the end of each of the second springs 27 located on the negative side of the Z axis is in indirect contact with the outer circumferential surface of a corresponding one of the cams 31 with a corresponding one of the pressing members 271 therebetween. The other end (an upper end) of each of the second springs 27 located on the positive side of the Z axis is engaged with a corresponding one of the pressure arms 24.

The motor M rotationally drives the cams 31 through the deceleration gear train TR and the shaft 31*a*. The deceleration gear train TR transmits rotary driving force from the motor M to the shaft 31*a* while decelerating rotational speed of the rotary driving force. The shaft 31*a* is eccentrically fixed to the cams 31. That is, the shaft 31*a* is fixed at positions of the respective cams 31 which positions are displaced from centers of the respective cams 31.

The outer circumferential surface of each of the cams 31 is in contact with a corresponding one of the pressing members 271. The cams 31 adjust urging force applied by the second springs 27 to the respective pressure arms 24.

Specifically, when the level of a topmost part of each of the cams 31 is raised, the end (the lower end) of a corresponding one of the second springs 27 located on the negative side of the Z axis is moved upwards via a corresponding one of the pressing members 271, and the second spring 27 is compressed. As a result, the second spring 27 urges a corresponding one of the pressure arms 24 upwards, resulting in an increase in pressing force acting between the heating roller 21 and the pressure roller 22.

To the contrary, when the level of the topmost part of each of the cams 31 is brought down, the end of the corresponding one of the second springs 27 located on the negative side of the Z axis is moved downwards via the corresponding one of the pressing members 271, and the second spring 27 expands. As a result, upward urging force of the second spring 27 acting on the corresponding one of the pressure arms 24 decreases, resulting in a decrease in the pressing force acting between the heating roller 21 and the pressure roller 22.

The detector 32 detects a rotation angle of the cams 31. Specifically, the detector 32 includes an actuator 33 and a photo interrupter (PI) sensor 34. The actuator 33 is fixed to the shaft 31*a*. The PI sensor 34 detects the rotation angle of the cams 31 by detecting whether or not the actuator 33 is interrupting light.

Figure 4:
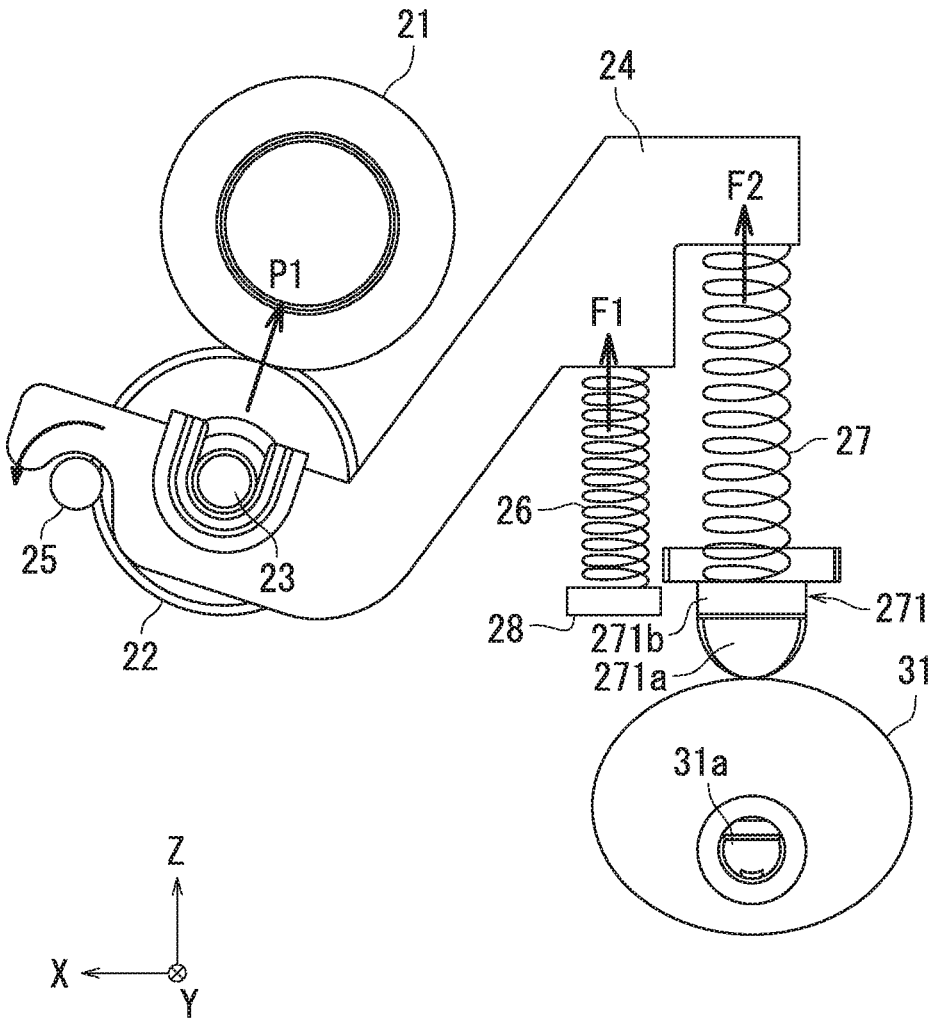
FIG. 4 is a diagram illustrating a structure for pressing the pressure roller against the heating roller.

The following describes a structure for pressing the pressure roller 22 against the heating roller 21 with reference to FIG. 4. FIG. 4 is a diagram illustrating the structure for pressing the pressure roller 22 against the heating roller 21. FIG. 4 illustrates a state in which maximum pressing force P1 is acting between the heating roller 21 and the pressure roller 22.

Each of the pressing members 271 includes a tip end portion 271*a* and a base portion 271*b* as illustrated in FIG. 4. The tip end portion 271*a* has a hemispherical shape. The base portion 271*b* has a cylindrical shape. The pressing member 271 is arranged such that its central axis is parallel to the Z axis.

The topmost part of the cam 31 presses the pressing member 271 (the tip end portion 271*a*) to compress the second spring 27. As a result, the second spring 27 urges the pressure arm 24 counterclockwise. Urging force F2 of the second spring 27 acts on the pressure arm 24. Also, urging force F1 of the first spring 26 acts on the pressure arm 24.

As a result of the urging force F1 and the urging force F2 acting on the pressure arm 24 as described above, the pressure arm 24 is urged counterclockwise about the spindle 25. Further, the pressure arm 24 urges the rotary shaft 23 toward the heating roller 21. As a result, the pressure roller 22 is pressed against the heating roller 21 with the maximum pressing force P1.

Figure 5A:
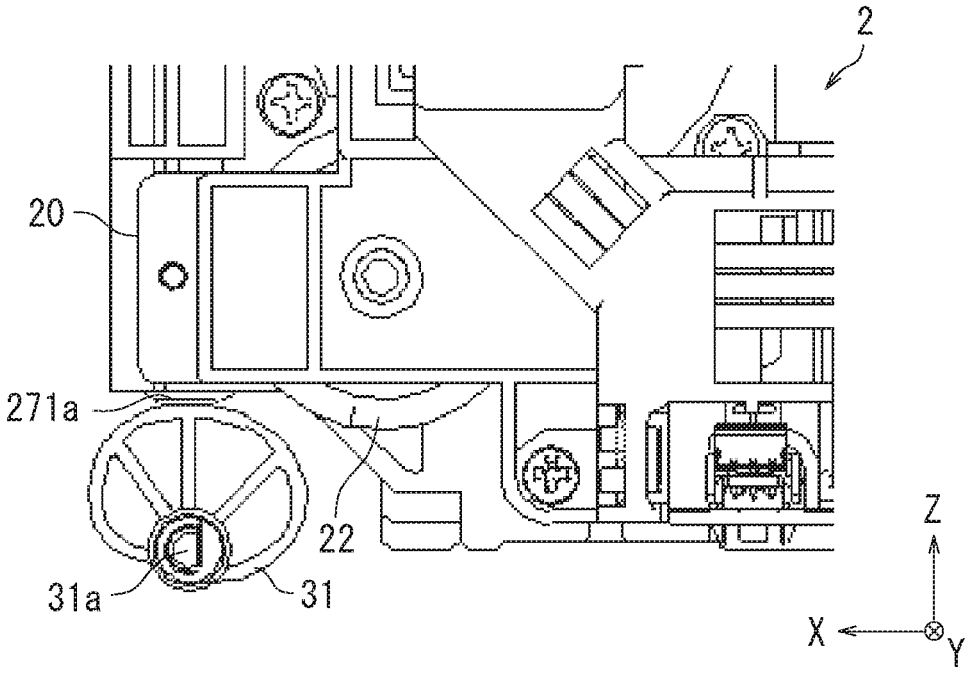
FIGS. 5A and 5B are side views each illustrating a state of a cam and a pressing member.
Figure 5B:
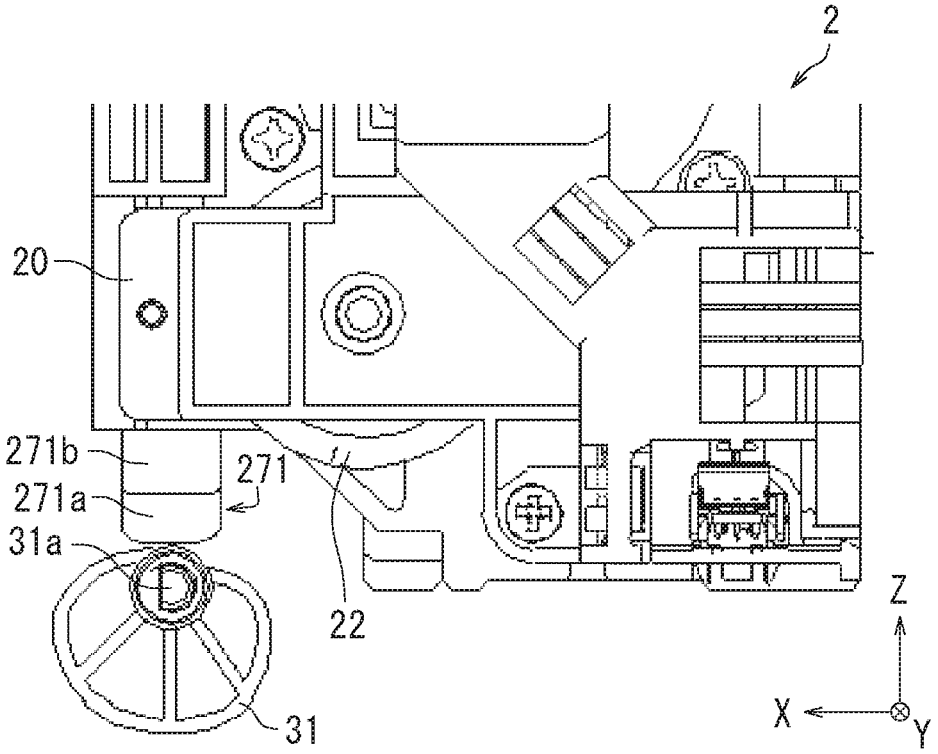

The following describes operation of each of the cams 31 and a corresponding one of the pressing members 271 with reference to FIGS. 1 to 5B. FIGS. 5A and 5B are side views each illustrating a state of the cam 31 and the pressing member 271. FIG. 5A is a diagram illustrating a state in which the pressing member 271 is pushed up to an upper limit position by the cam 31. FIG. 5B is a diagram illustrating a state in which the pressing member 271 descends to a lower limit position.

The cam 31 rotates as illustrated in FIGS. 5A and 5B in accompaniment with rotation of the shaft 31*a*. The fixing unit 2 further includes a frame 20. The heating roller 21, the pressure roller 22, the pressure arms 24, the spindles 25, the first springs 26, the second springs 27, the pressing members 271, and the fixing frames 28 are located within the frame 20.

In the state in which the pressing member 271 is pushed up to the upper limit position by the cam 31, only the tip end portion 271*a* of the pressing member 271 protrudes from the frame 20, as illustrated in FIG. 5A. When the cam 31 rotates by 180 degrees from this state, the pressing member 271 descends to the lower limit position, as illustrated in FIG. 5B. In this state, the base portion 271*b* of the pressing member 271, as well as the tip end portion 271*a*, protrudes from the frame 20.

Figure 6:
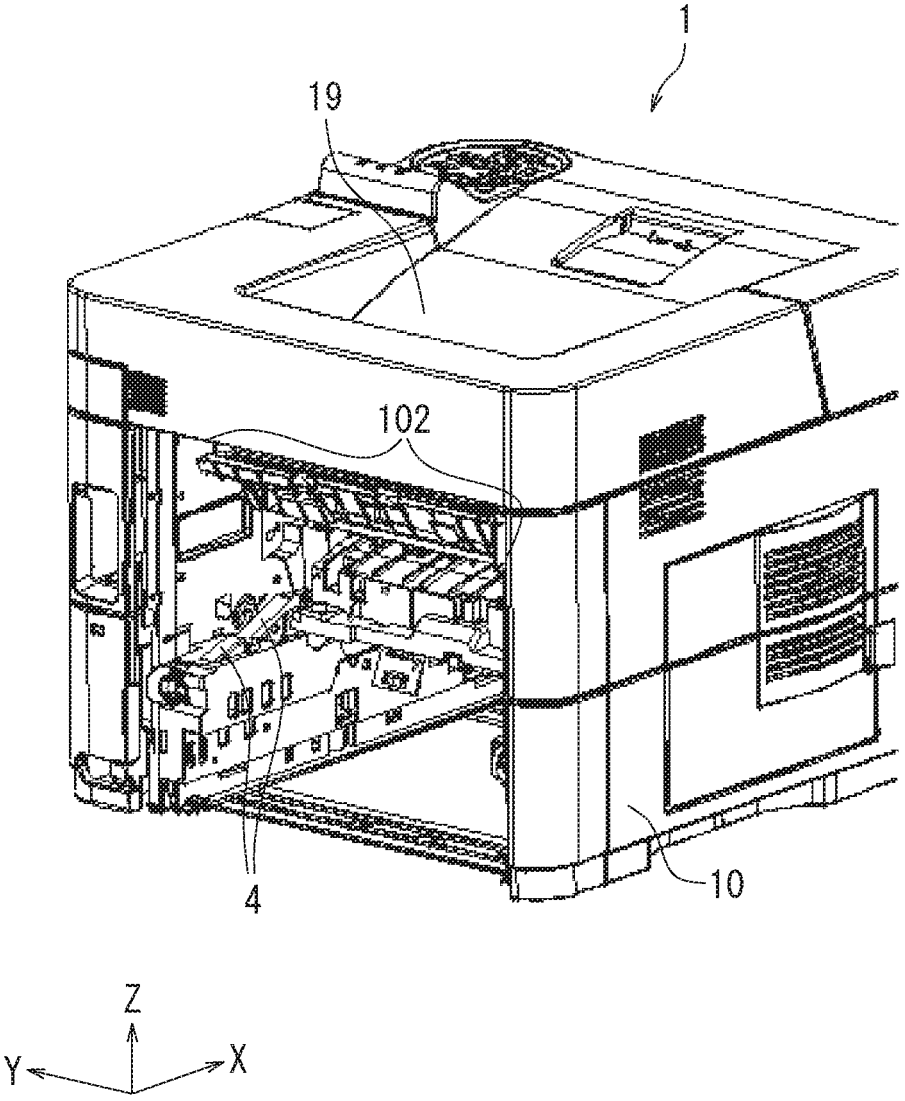
FIG. 6 is a perspective view illustrating a state in which the fixing unit is detached from the main body.

The following describes slope members 4 with reference to FIGS. 1 to 6. FIG. 6 is a perspective view illustrating a state in which the fixing unit 2 is detached from the main body 10. Note that the rear cover 101 is removed in FIG. 6. The slope members 4 each guide the lower end of a corresponding one of the pressing members 271 to the topmost part of a corresponding one of the cams 31 in attachment of the fixing unit 2 to the main body 10.

As illustrated in FIG. 6, the paired slope members 4 are provided at respective positions each opposite to a corresponding one of the paired pressing members 271 illustrated in FIG. 3. Specifically, each of the paired slope members 4 is located close to a corresponding one of paired edges of the opening 102 extending in the direction of the Z axis. The slope members 4 extend in a direction parallel to a direction (a direction in which the X axis tends) in which the fixing unit 2 is attached to the main body 10.

As described above with reference to FIGS. 1 to 6, the slope members 4 each guide the lower end of the corresponding one of the pressing members 271 to the topmost part of the corresponding one of the cams 31 in attachment of the fixing unit 2 to the main body 10 in the embodiment of the present disclosure. Therefore, the fixing unit 2 can be attached to the main body 10 irrespective of the rotation angle of the cams 31.

Further, the slope members 4 extend in the direction parallel to the direction in which the fixing unit 2 is attached to the main body 10. Therefore, the slope members 4 are each capable of surely guiding the lower end of the corresponding one of the pressing members 271 to the topmost part of the corresponding one of the cams 31.

Figure 7A:
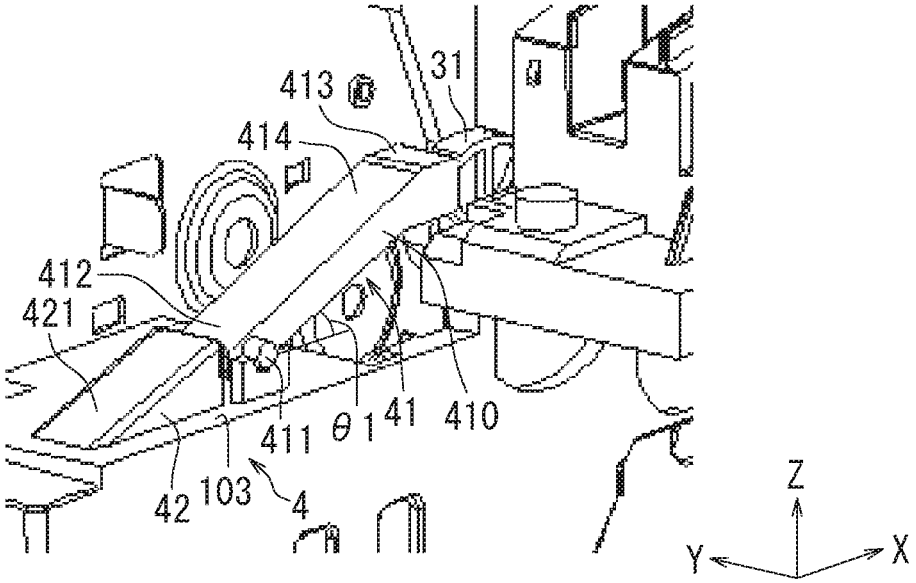
FIGS. 7A and 7B are perspective views each illustrating a slope member.
Figure 7B:
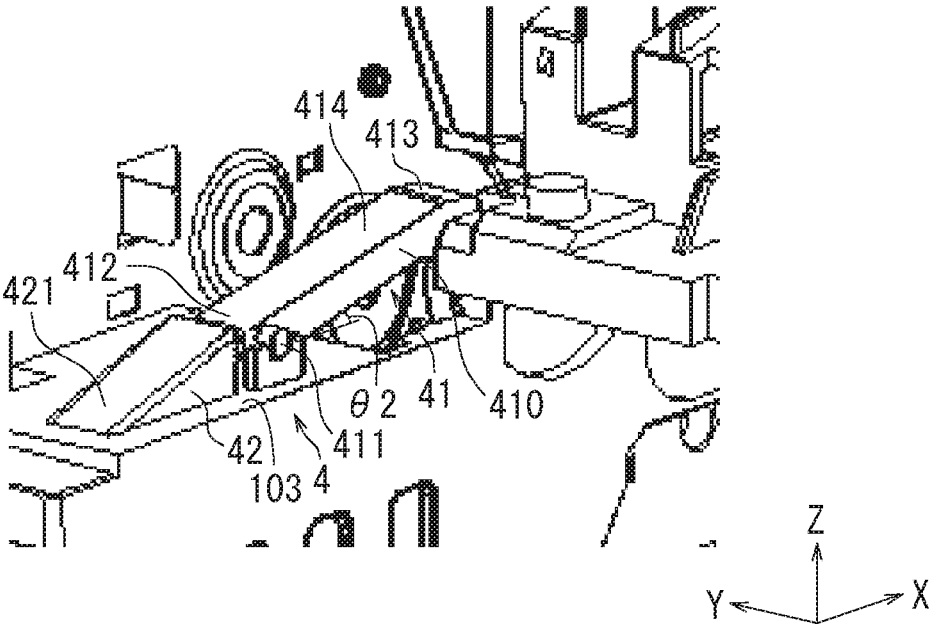

The following describes a configuration of each of the slope members 4 with reference to FIGS. 1 to 7B. FIGS. 7A and 7B are perspective views each illustrating one of the slope members 4. FIG. 7A is a diagram illustrating a state in which the cam 31 is located at an upper limit position. The upper limit position of the cam 31 refers to a position of the cam 31 when the pressing member 271 is located at its upper limit position. FIG. 7B is a diagram illustrating a state in which the cam 31 is located at a lower limit position. The lower limit position of the cam 31 refers to a position of the cam 31 when the pressing member 271 is located at its lower limit position.

As illustrated in FIG. 7A, the slope member 4 includes a first member 41 and a second member 42. The first member 41 includes a column-shaped member 410 and a rod member 411. The column-shaped member 410 has a rectangular columnar shape, and includes a base end portion 412, a tip end portion 413, and a first slide surface 414. The main body 10 further includes a frame 103.

The column-shaped member 410 is rotatably supported at the base end portion 412 thereof. Specifically, the rod member 411 extends in parallel to the Y axis through the base end portion 412 of the column-shaped member 410. The rod member 411 is rotatably supported by the frame 103. The tip end portion 413 of the column-shaped member 410 slides on the circumferential surface of the cam 31. The base end portion 412 corresponds to "one of ends" of the first member 41. The tip end portion 413 corresponds to "another end" of the first member 41.

The first slide surface 414 is an upper surface of the column-shaped member 410. In attachment of the fixing unit 2 to the main body 10, the tip end portion 271*a* of the pressing member 271 slides on the first slide surface 414.

The first member 41 is rotatably supported at its base end portion 412, and the tip end portion 413 of the first member 41 slides on the circumferential surface of the cam 31. In this configuration, when the cam 31 is located at its upper limit position, the first member 41 inclines at an angle θ1 relative to the X axis.

The second member 42 is located on the negative side (the rear side) of the X axis relative to the first member 41. The second member 42 has a triangular prism shape. A cross section of the second member 42 parallel to an X-Z plane has the shape of a right triangle. The second member 42 is fixed to the frame 103. The second member 42 has a second slide surface 421. The second slide surface 421 is an upper surface of the second member 42. In attachment of the fixing unit 2 to the main body 10, the tip end portion 271*a* of the pressing member 272 slides on the second slide surface 421. In FIG. 7B, the cam 31 is located at its lower limit position. The first member 41 is rotatably supported at its base end portion 412, and the tip end portion 413 of the first member 41 slides on the circumferential surface of the cam 31. In this configuration, when the cam 31 is located at its lower limit position, the first member 41 inclines at an angle θ2 relative to the X axis. The angle θ2 is smaller than the angle θ1.

As illustrated in FIGS. 7A and 7B, an end of the second slide surface 421 close to the first member 41 is higher than an end of the first slide surface 414 close to the second member 42. Therefore, the lower end of the pressing member 271 is guided to the topmost part of the cam 31 via the second slide surface 421 and the first slide surface 414 in attachment of the fixing unit 2 to the main body 10.

As described above with reference to FIGS. 1 to 7B, the base end portion 412 of the first member 41 is rotatably supported, and the tip end portion 413 of the first member 41 slides on the circumferential surface of the cam 31. Therefore, the first member 41 is capable of surely guiding the lower end of the pressing member 271 to the topmost part of the cam 31 irrespective of the rotation angle of the cam 31.

Also, the second member 42 guides the lower end of the pressing member 271 to the base end portion 412 of the first member 41 in attachment of the fixing unit 2 to the main body 10. Through the above, the lower end of the pressing member 271 can be guided to the base end portion 412 of the first member 41 in attachment of the fixing unit 2 to the main body 10. Therefore, the slope member 4 is capable of surely guiding the lower end of the pressing member 271 to the topmost part of the cam 31.

Further, the end of the second slide surface 421 close to the first member 41 is higher than the end of the first slide surface 414 close to the second member 42. In this configuration, the lower end of the pressing member 271 is smoothly guided to the topmost part of the cam 31 via the second slide surface 421 and the first slide surface 414 in attachment of the fixing unit 2 to the main body 10. Therefore, the slope member 4 is capable of smoothly guiding the lower end of the pressing member 271 to the topmost part of the cam 31.

Figure 8A:
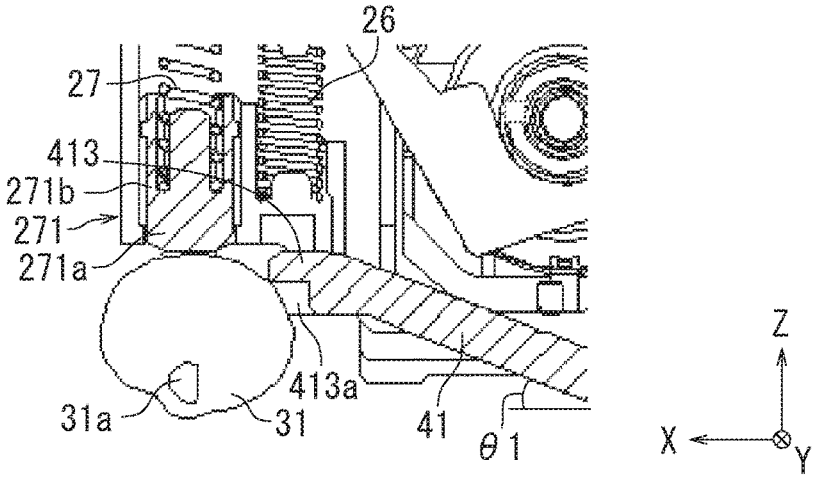
FIGS. 8A, 8B, and 8C are cross-sectional views each illustrating the slope member.
Figure 8B:
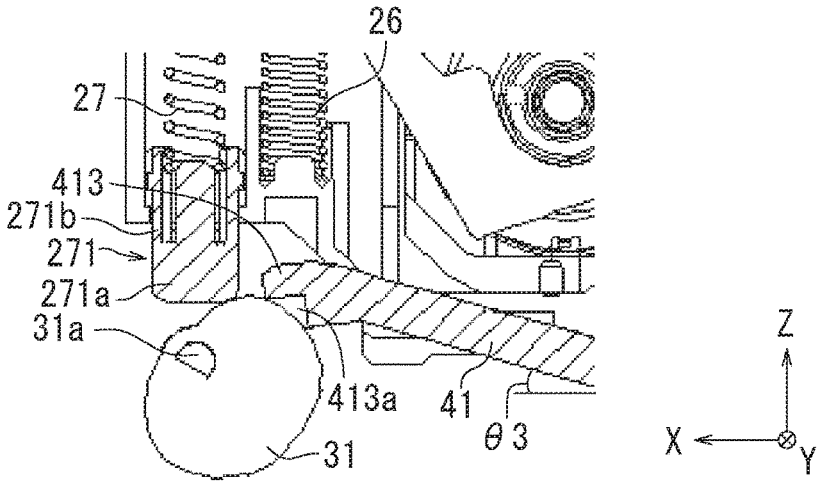
Figure 8C:
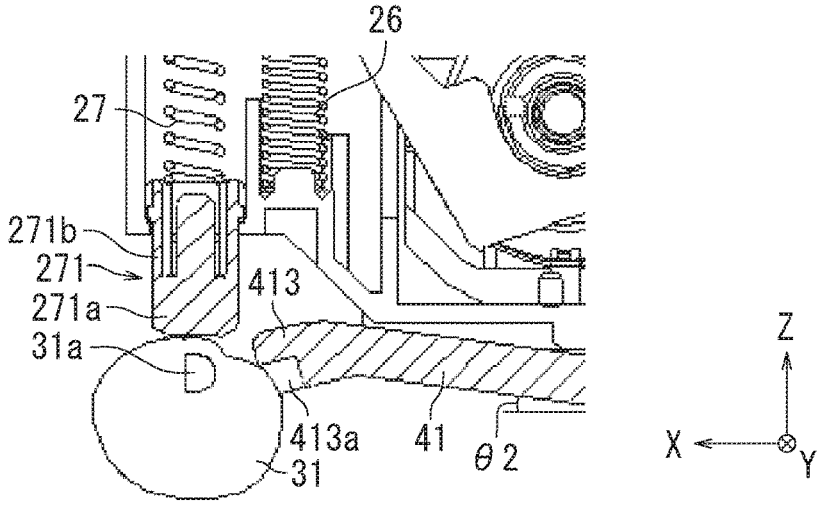

The following describes operation of each of the slope members 4 with reference to FIGS. 1 to 8C. FIGS. 8A, 8B, and 8C are cross-sectional views each illustrating one of the slope members 4. FIG. 8A is a diagram illustrating a state in which the cam 31 is located at its upper limit position. FIG. 8B is a diagram illustrating a state in which the cam 31 is located between its upper limit position and its lower limit position. FIG. 8C is a diagram illustrating a state in which the cam 31 is located at its lower limit position.

As illustrated in FIGS. 8A to 8C, a notch 413*a* is formed in the tip end portion 413 of the first member 41. The notch 413*a* is formed at a lower side of the tip end portion 413 at a tip end side thereof. Therefore, a part of the tip end portion 413 where the notch 413*a* is formed has a smaller thickness than the other part of the tip end portion 413.

When the cam 31 is located at its upper limit position as illustrated in FIG. 8A, the first member 41 inclines at the angle θ1 relative to the X axis. When the cam 31 is located at its lower limit position as illustrated in FIG. 8C, the first member 41 inclines at the angle θ2 relative to the X axis. When the cam 31 is located between its upper limit position and its lower limit position as illustrated in FIG. 8B, the first member 41 inclines at an angle θ3 relative to the X axis. The angle θ3 is larger than the angle θ2 and smaller than the angle θ1.

As illustrated in FIGS. 8A to 8C, the angle of the first member 41 relative to the X axis increases from the angle θ2 to the angle θ1 as the cam 31 rotates from its lower limit position to its upper limit position.

Further, when the pressing member 271 is located at a pressing position (the upper limit position) as illustrated in FIG. 8A, the position of a topmost part of the first member 41 is located at substantially the same level as the position of the topmost part of the cam 31. Specifically, the topmost part of the first member 41 corresponds to a topmost part of the tip end portion 413 of the first member 41.

As described above with reference to FIGS. 1 to 8C, the notch 413*a* is formed in the tip end portion 413 of the first member 41 and the part of the tip end portion 413 where the notch 413*a* is formed has a smaller thickness than the other part of the tip end portion 413 in the embodiment of the present disclosure. Therefore, it is possible to prevent interference between the tip end portion 413 of the first member 41 and a member of the fixing unit 2 when the tip end portion 413 ascends or descends along with rotation of the cam 31.

Further, when the pressing member 271 is located at the pressing position, the topmost part of the first member 41 is located at substantially the same level as the topmost part of the cam 31. Therefore, when the pressing member 271 is located at the pressing position, the first member 41 is capable of smoothly guiding the lower end of the pressing member 271 to the topmost part of the cam 31.

Figure 9A:
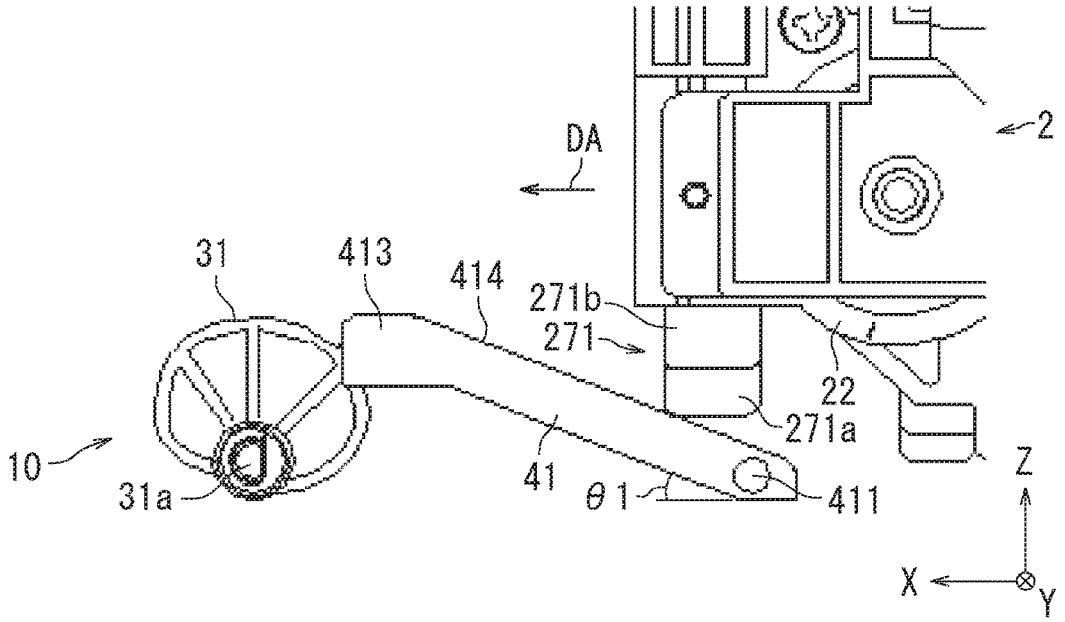
FIGS. 9A and 9B are side views illustrating an operation for attaching the fixing unit to the main body.
Figure 9B:
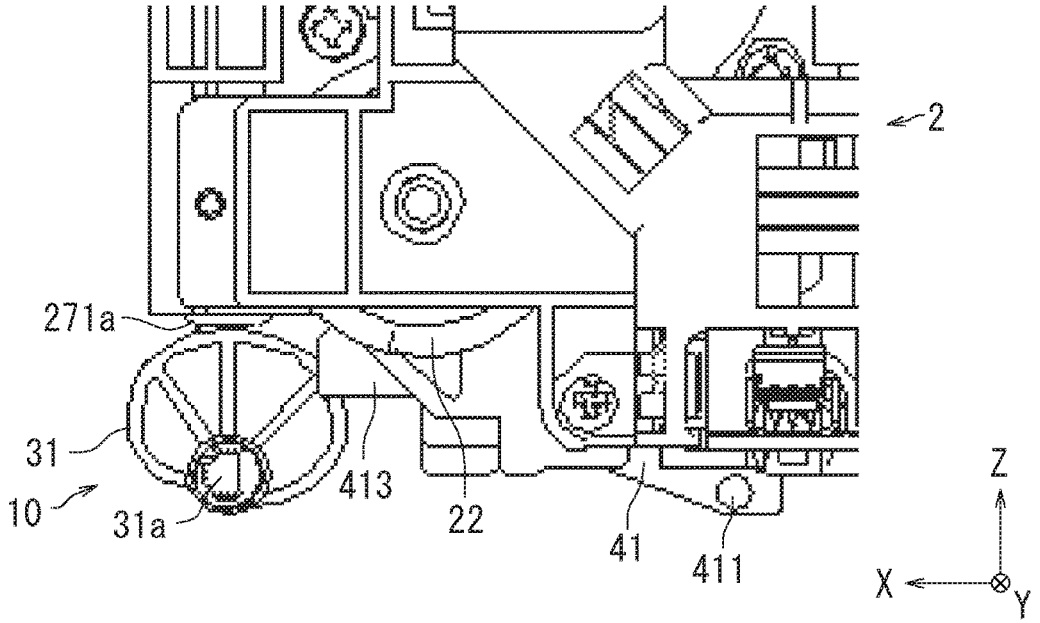

The following describes an operation for attaching the fixing unit 2 to the main body 10 with reference to FIGS. 1 to 9B. FIGS. 9A and 9B are side views illustrating the operation for attaching the fixing unit 2 to the main body 10. FIG. 9A is a cross-sectional view illustrating a state in which the fixing unit 2 is in the course of being attached to the main body 10. FIG. 9B is a cross-sectional view illustrating a state in which the fixing unit 2 is attached to the main body 10.

As illustrated in FIG. 9A, the cam 31 is located at its upper limit position and the first member 41 inclines at the angle θ1 relative to the X axis. The fixing unit 2 is moved in a direction DA parallel to the X axis. The tip end portion 271*a* of the pressing member 271 slides on the first slide surface 414 of the first member 41. As the fixing unit 2 is moved in the direction DA, the pressing member 271 is pressed and moved toward its upper limit position by the first member 41 inclining at the angle θ1 relative to the X axis.

When the fixing unit 2 is attached to the main body 10 as illustrated in FIG. 9B, the pressing member 271 is moved from the first slide surface 414 to the topmost part of the cam 31 while being guided by the first member 41.

As described above with reference to FIGS. 1 to 9B, the slope member 4 guides the lower end of the pressing member 271 to the topmost part of the cam 31 in attachment of the fixing unit 2 to the main body 10 in the embodiment of the present disclosure. Therefore, the fixing unit 2 can be attached to the main body 10 irrespective of the rotation angle of the cam 31.

Through the above, the embodiment of the present disclosure has been described with reference to the drawings. However, the present disclosure is not limited to the above embodiment and is practicable in various manners within a scope not departing from the gist of the present disclosure (for example, as described below in (1) and (2)). The drawings schematically illustrate elements of configuration in order to facilitate understanding, and properties of the elements of configuration illustrated in the drawings, such as thicknesses, lengths, and numbers thereof, may differ from actual properties thereof in order to facilitate preparation of the drawings. Furthermore, properties of the elements of configuration described in the above embodiment, such as shapes and dimensions, are merely examples, and various alterations may be made within a scope not substantially departing from the configuration of the present disclosure.

(1) As described above with reference to FIGS. 1 to 4, the first springs 26 and the second springs 27 urge the pressure roller 22 against the heating roller 21. However, the present disclosure is not limited to this configuration. It is only required that at least one spring urges the pressure roller 22 against the heating roller 21.

(2) As described above with reference to FIGS. 1 to 9B, the slope members 4 each include the first member 41 and the second member 42. However, the present disclosure is not limited to this configuration. It is only required that the slope members 4 each guide the lower end of a corresponding one of the pressing members 271 to the topmost part of a corresponding one of the cams 31 in attachment of the fixing unit 2 to the main body 10. The slope members 4 may each include the first member 41 only, for example. In this configuration, the structure of the slope members 4 can be simplified.

What is claimed is:

1. An image forming apparatus comprising:

a main body; and a fixing unit attachable to and detachable from the main body, wherein the fixing unit includes a heating roller, a pressure roller, and a pressing member that presses the pressure roller against the heating roller, and the main body includes:

a cam that changes a pressing state of the pressing member; and a slope member that guides a lower end of the pressing member to a topmost part of the cam in attachment of the fixing unit to the main body.

2. The image forming apparatus according to claim 1, wherein the slope member extends in a direction parallel to a direction in which the fixing unit is attached to the main body.

3. The image forming apparatus according to claim 1, wherein the slope member includes a first member, and the first member has ends, one end of which is rotatably supported and another end of which slides on a circumferential surface of the cam.

4. The image forming apparatus according to claim 3, wherein when the pressing member is located at a pressing position, a topmost part of the first member is located at substantially the same level as the topmost part of the cam.

5. The image forming apparatus according to claim 3, wherein the slope member further includes a second member, and the second member guides the lower end of the pressing member to the one end of the first member in attachment of the fixing unit to the main body.

6. The image forming apparatus according to claim 5, wherein the second member has a triangular prism shape and has a second slide surface, the second slide surface is an upper surface of the second member, and the lower end of the pressing member slides on the second slide surface in attachment of the fixing unit to the main body.

7. The image forming apparatus according to claim 1, wherein the slope member includes a first member, the first member includes a rod member and a column-shaped member having a base end portion and a tip end portion, the rod member rotatably supports the base end portion of the column-shaped member, and the tip end portion of the column-shaped member slides on a circumferential surface of the cam.

8. The image forming apparatus according to claim 7, wherein the column-shaped member has a rectangular columnar shape and has a first slide surface, the first slide surface is an upper surface of the column-shaped member, and the lower end of the pressing member slides on the first slide surface in attachment of the fixing unit to the main body.

9. The image forming apparatus according to claim 7, wherein the tip end portion of the column-shaped member has a notch, the notch being located at a lower side of the tip end portion at a tip end side thereof.

* * * * *